United States Patent [19]

Shahar

[11] 4,033,548

[45] July 5, 1977

[54] CONCRETE SHUTTERING CONNECTING MEANS

[76] Inventor: Moshe Shahar, 34 Semadar St., Ramat Gan, Israel

[22] Filed: May 12, 1975

[21] Appl. No.: 576,312

[30] Foreign Application Priority Data

Aug. 30, 1974 Israel ..... 45574

[52] U.S. Cl. ..... 249/194; 249/47; 249/48; 249/192; 249/193

[51] Int. Cl.[2] ..... E04G 17/02

[58] Field of Search ..... 249/44–45, 249/47–49, 163, 191–194, 219 R; 52/753 C, 753 D, 758 C, 758 D; 217/12 R

[56] References Cited

UNITED STATES PATENTS

| | | | |
|---|---|---|---|
| 1,129,658 | 2/1915 | Foy | 249/193 |
| 1,256,202 | 2/1918 | Collins | 217/12 R |
| 3,594,028 | 7/1971 | Scott | 52/578 D |
| 3,664,630 | 5/1972 | Maynew et al. | 249/112 |

FOREIGN PATENTS OR APPLICATIONS

| | | | |
|---|---|---|---|
| 30,612 | 10/1922 | Denmark | 52/753 C |

*Primary Examiner*—Francis S. Husar
*Assistant Examiner*—John McQuade
*Attorney, Agent, or Firm*—Browdy and Neimark

[57] ABSTRACT

Shuttering elements, for assembly as casting moulds in which concrete structures are cast, are composed of planks or panels which are made with undercut grooves extending near an edge of the respective plank or panel, profiled rails being provided which are fittingly slid into the grooves of two planks or panels thereby firmly connecting these two planks or panels.

2 Claims, 17 Drawing Figures

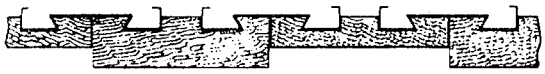
Fig. 9
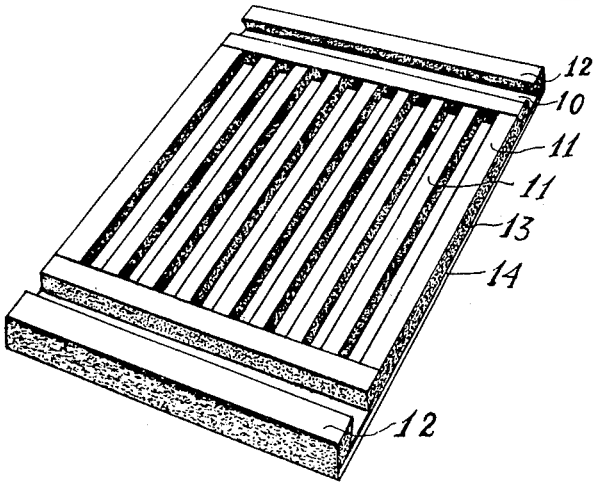
Fig. 10a
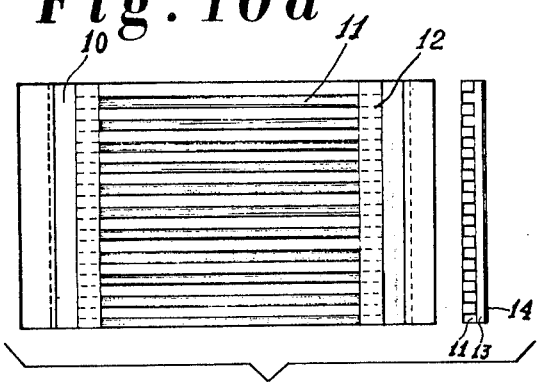
Fig. 10
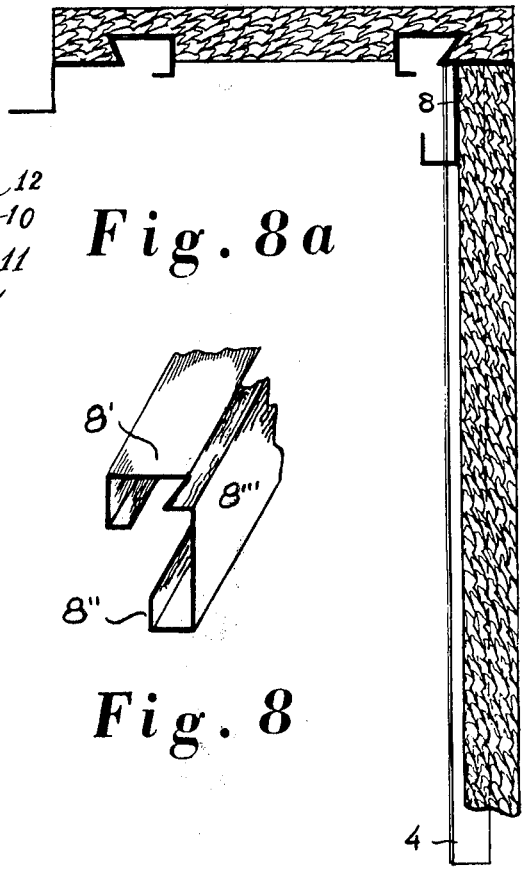
Fig. 8a
Fig. 8
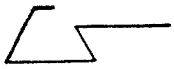
Fig. 11
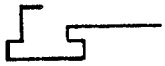
Fig. 12
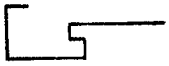
Fig. 13

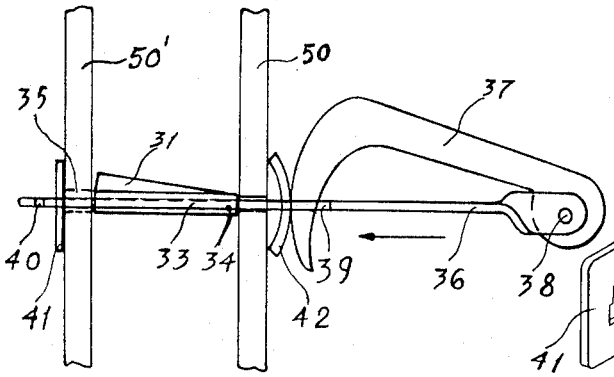
Fig. 14
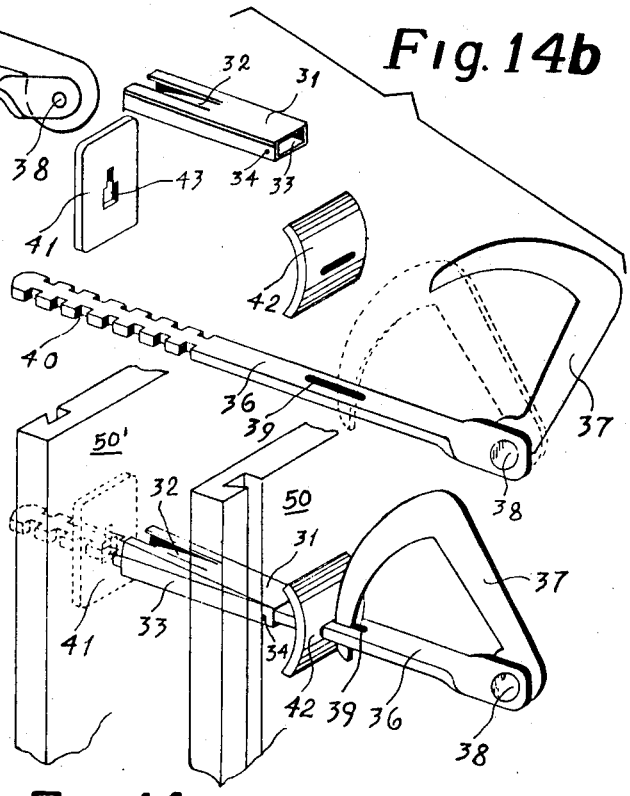
Fig. 14b
Fig. 14c
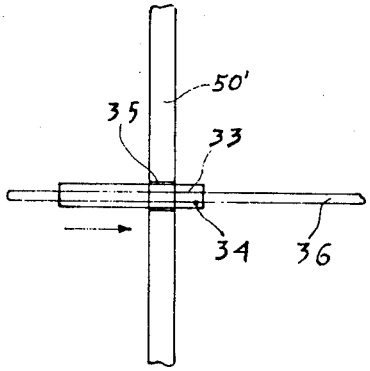
Fig. 14a
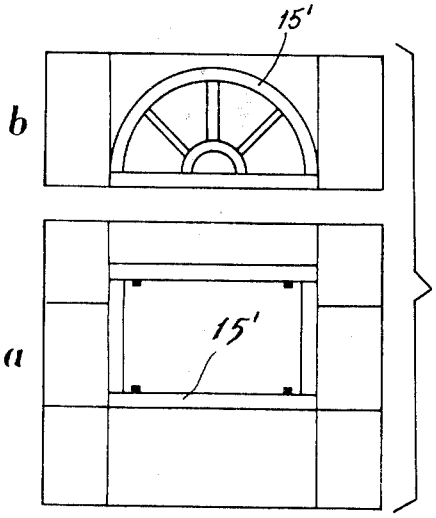
Fig. 15
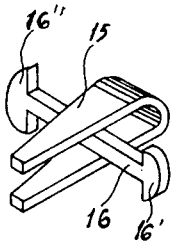
Fig. 16
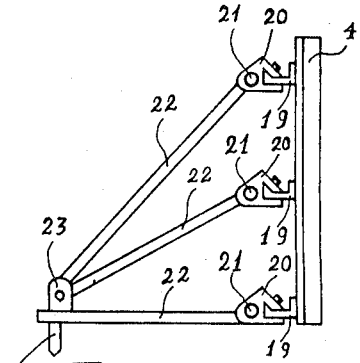
Fig. 17

CONCRETE SHUTTERING CONNECTING MEANS

BACKGROUND OF INVENTION

As is well known structural concrete casting are produced with the use of shutterings of timber planks which are held together by nailing plank to plank or by auxiliary connecting members, such as wooden bars, fillets and the like.

The work connected with preparation of the shuttering for a building or any other structure, or part of it, is quite considerable and, above all, time consuming.

It has also been suggested to use metal sheets and to build up shutterings from the latter. However, these metal members have been used only in cases where standardized, mostly prefabricated, building elements were cast. Quite complicated and costly connecting members for such individual metal planks have been suggested which only in the case of use for prefabricated, standardized elements do not materially affect the cost of the building structure.

OBJECTS OF THE INVENTION

The object of this invention is to provide elements which can be produced and assembled easily and so simply that the work might be done even by unskilled, laborers. Thus a great economising both of time and cost as well as of material will be achieved.

SHORT SUMMARY OF INVENTION

In its broadest aspects the invention therefore resides in the basic idea of assembling shutterings for casting therein parts of buildings such as walls, columns, girders, floors etc., characterized in that the individual planks or panels out of which such a shuttering is formed are connected by means of repeatedly usable easily insertable and easily removable connecting members. In a specific arrangement which I have found to be the most advantageous, the connection is afforded by means of groove and tongue connections, the grooves being provided in the individual planks or panels while profiled rails connecting such panels are the tongue members of the connection. Incidentally, since the individual panels are intended for repeated use and may be made therefor of more expensive material than usually used for such purposes, the panels or planks may be provided with ornamentation in relief or basrelief, so that after casting the elements or parts of building cast therein will be accordingly and correspondingly ornamented.

More particularly, the new shutterings and especially those permitting ornamentation of the cast parts can be used with great advantage in casting ceilings. As is well known ceilings are hard or difficult to plaster since the application of plaster from below is not only a matter of skill but also a time consuming operation. It would be desirable therefor to do away with the plastering which can be achieved by the incidental use of the new shuttering elements provided with ornamentation. In such a case on top of the shuttering there may be cast a thin layer of gypsum or white cement onto which the customary load bearing floor is cast which unites with the said thin layer and sets together with it. After removal of the shuttering, the underside of the floow, that is to say the ceiling of the room underneath, is white and possibly even provided with ornamentation. But even in those cases where no gypsum or white cement is used a smooth underside of ordinary portland cement ceiling would need no further plastering and can be whitewashed only or provided with a coat of paint, such as might be desirable.

Accordingly the invention further provides elements for the assembly of shutterings for casting therein structural concrete parts of buildings — either at the site where the building is to be erected — or in a plant producing prefabricated building element. The elements form a set the individual constituents of which are interconnectable in varying combinations, the connections being realized by means of tongue and groove joints.

The new method comprises the steps of providing planks or panels which are fitted with grooves — preferably dovetailed grooves — or undercut grooves and profiled rails having two longitudinal ribs adapted to enter into and be engaged by the grooves of two vicinally placed panels or planks, thereby uniting the latter.

The invention further provides the means for carrying the method into effect, namely a set of elements including:

a. at least one profiled rail constituting the tongue element b. at least two planks provided with grooves in which the said rail can be received.

Obviously, in actual use and for all practical purposes a multiple number of planks and a corresponding number of rails will be used, each rail connecting to vicinal planks or panels.

The rails will preferably be metal rails and most advantageously they will be prepared from sheet metal, e.g. tin sheet by conventional bending processes on conventional machinery.

In a very advantageous manner the rails may be made of aluminum and produced by conventional extrusion processes. The planks may be made of any material such as: metal, wood, plastic or fiberglass reinforced polyester compound. Corrugated sheet metal may also be used for making the planks. Any other conventional material of the type and kind referred to above may of course be used and naturally also combinations of such materials.

According to one feature of the invention, the planks, all having identical parallel grooves, are preferably made in several groups of sizes. The variety of sizes enables assembly every combination of shutterings of any size or design. The mode of assembling the elements to form the desired shuttering is simple. The laborer selects the appropriate profiled rails and the appropriate size of planks to be used in a certain piece of work. The planks which are to be connected by the rails are slid with their grooves onto a profiled rail until the rail is fully received within a groove or grooves, so as to form a long or wide plank assembly according to the required size. Such plank assemblies being individual units coupled together, may constitute any design of shuttering required, such as internal and external corners, U channels, square columns, straight long walls, or even complete buildings.

SHORT DESCRIPTION OF DRAWINGS the annexed drawings illustrate the following:

FIG. 1 illustrates a first form of profiled connecting rail in accordance with the present invention; FIG. 1*a* shows a plank for use with the connecting rail of FIG. 1; and FIG. 2 shows a second rail intended for use with the rail of FIG. 1;

FIG. 1*b* illustrates the assembly of the elements of FIGS. 1, 2 and 1*a;* and FIGS. 2*a* and 2*b* show connected assemblies;

FIGS. 4–8 show additional profiled rail embodiments in accordance with the present invention; and FIGS. 4*a*–8*a* show, respectively, each of the rails of FIGS. 4–8 in assembly with planks;

FIG. 9 is a fractional, sectional view for casting ornamented parts;

FIGS. 10 and 10*a* show forms of planks which may be used in the present invention.

FIGS. 11, 12 and 13 are further examples of connecting rails according to the invention.

FIGS. 14, 14*a*, 14*b*, and 14*c* illustrate as auxiliary means for use with the new shuttering elements FIGS. 16 and 17 illustrate different auxiliary means; and FIG. 15 exemplifies the inclusion of a window frame in a shuttering intended for casting a wall.

DETAILED DESCRIPTION OF EMBODIMENTS

Figure 1:
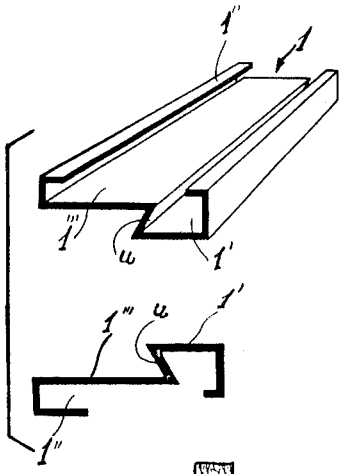

Turning first to FIG. 1 there is shown both in perspective and in an end view a profiled rail indicated as a whole by the numeral 1. This rail has a "tongue" portion 1′ and a hook portion 1″ which are connected by a flat strip 1‴. The tongue portion, as common to all tongue and groove joints, is undercut at least at one of its longitudinal sides; in the present case at *u*.

Figure 1A:
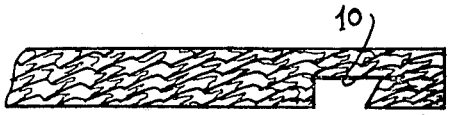
Figure 1B:
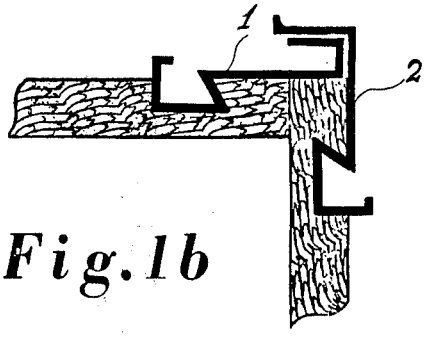

FIG. 1*a* shows in a fractional section a plank having a profiled groove 10 which is shaped and dimensioned to receive in its interior the tongue portion of rail 1. To effect this connection, the rail is simply pushed into the groove 10. FIG. 1*b* shows two adjacent planks with the rails in place ready for connection.

Figure 2:
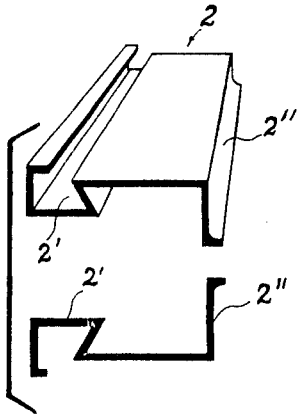

FIG. 2 shows an identical rail, the difference being that its hook portion 2 being differently orientated as compared with the rail of FIG. 1.

Figure 2A:
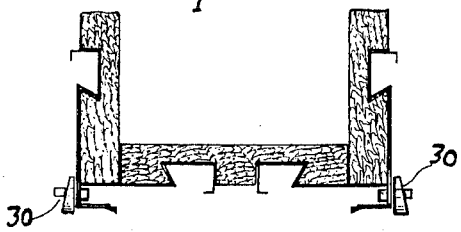

The connection of several planks to form a trough shaped mold is exemplified by FIG. 2*a*. Having fitted the planks with rails, the planks are laid onto one another in planes which are normal to one another thus forming a trough, or in practice the end of a shuttering or, if placed horizontally, one for erecting a beam. In doing so the hook portion 1″ of one rail will come to overlie and embrace the hook portion of the second rail, which then are made fast by means of a connection 30 (which will be described in detail later on), thereby firmly connecting the planks and immobilizing them in relation to one another. It should be observed that the connection so produced extends at the outer side of the shuttering formed by the connected planks. Obviously, any other conventional connecting means may be used.

Figure 2B:
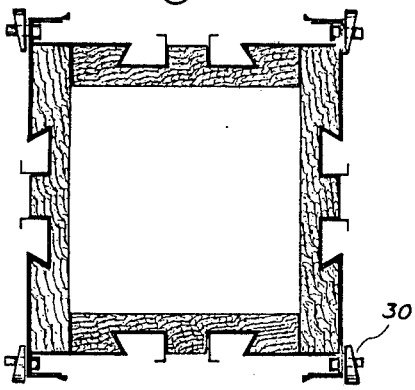

FIG. 2*b* shows the connection of four planks, forming a column in the manner and by the means described in connection with FIG. 2*a*.

Figure 3:
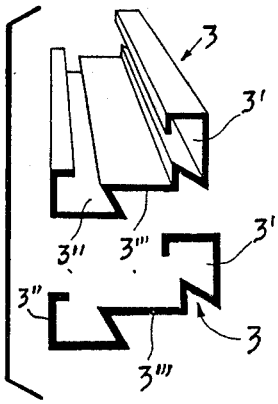
FIG. 3 illustrates another form of connecting rail.
Figure 3A:
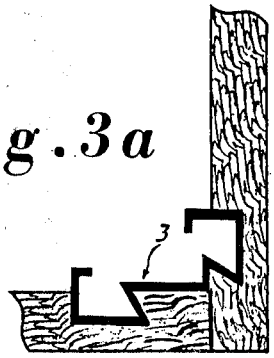
FIG. 3*a* shows the connecting rail of FIG. 3 used to assemble a corner piece.

FIG. 3 show another example of a profiled rail 3, this one possessing two tongue parts 3′ and 3″, connected by a flat strip 3‴. This rail 3 is used to interconnect two planks, as shown in FIG. 3*a*. Both planks are provided, as described already, with suitable grooves. The rail 3 is slid with tongues 3′ and 3″ into the grooves of the two planks, thus connecting the two planks, the connecting rail extending inside the angle formed by the two planks, and thus the assembly forms the external corner of a shuttering.

Figure 4:
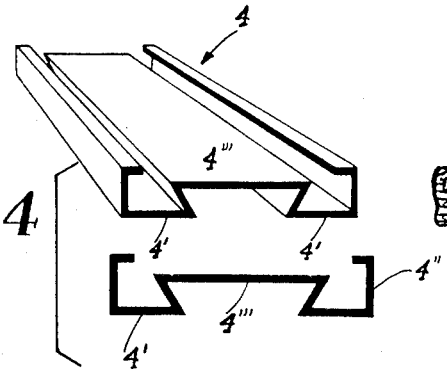
Figure 4A:
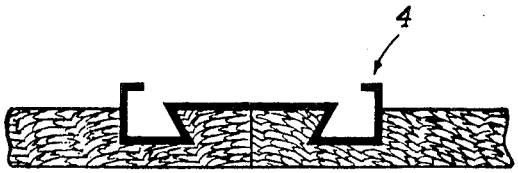

FIG. 4 shows a profiled rail 4 with two tongue parts 4′4″ positioned at the same level and connected by a flat strip 4‴. This rail is used, as shown in FIG. 4*a* to connect two planks co-planarly, as used for the casting of walls of certain height and/or width.

Figure 5:
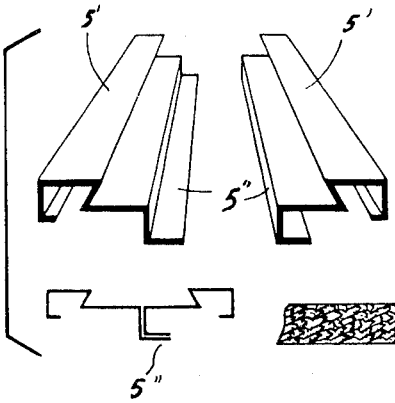
Figure 5A:
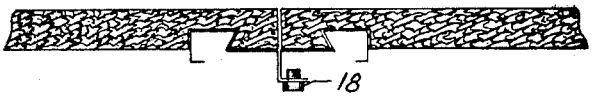

A co-planar assembly of two planks, according to FIG. 5*a* can also be obtained by using the rails shown in FIG. 5, both having a tongue part 5′ these rails having complementary hook parts 5″ as already described. With two planks positioned co-planarly as shown in FIG. 5*a* the hooks 5″ are made to engage one another, whereupon the two rails are connected by screws 18 passing through parts 5″.

Figure 6:
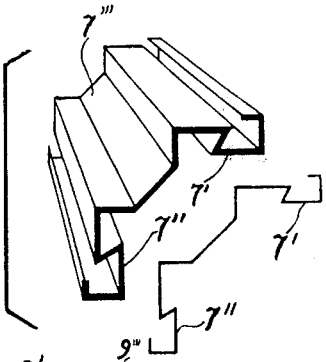
Figure 6A:
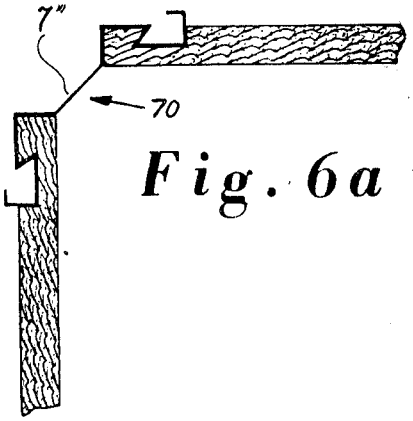

FIG. 6 shows a profiled rail having two tongue portions 7′ and 7″ positioned at right angles to one another and connected by a flat strip 7‴ oblique to both tongue portions. As shown in FIG. 6*a* this rail serves to connect two planks positioned to form a right angle but leaving a gap 70 at the peak of the angle. This gap is bridged in the assembly by the flat strip portion 7‴ of the rail. Such a connection is needed where a structural part is to be cast which should not have a sharp edge, i.e, its blunted edge being formed at the location of the portion 7‴.

Figure 7:
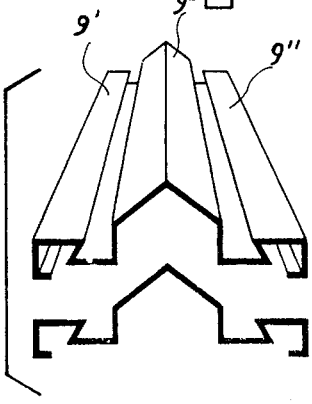
Figure 7A:
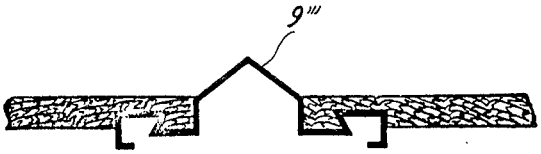

FIG. 7 shows a rail having two tongue parts 9′ and 9″ connected by a portion 9‴ of inverted V shape. This may be used, as shown in FIG. 7*a*, for connecting two co-planar panels. The inverted V portion, in the ultimate cast, results in a groove in that part of the structure, i.e., a vertical groove in a wall.

Finally in FIG. 8 there is shown a profiled rail which is intended for use in connecting a vertically placed plank with one horizontally placed, such as used in casting a ceiling on an already cast wall, or to cast simultaneously both the ceiling or floor together with the wall. Here there is provided tongue portion 8′ and a hook portion 8″ connected by a flat strip 8‴ of wider extension than in the previously described rail portions. The use of this connecting member is self understood from a glance at FIG. 8*a*.

The hook portions shown in the FIGS. 1–8 and described are not all identical, but the tongue portion is always the same. However, it would be within the scope of the invention to form such a portion as shown in FIG. 11, i.e., fitting into a groove undercut at both lateral sides. On the other hand, in lieu of an undercut side, the side of the tongue portion may be stepped as shown in FIGS. 12 and 13. In all these variations, the grooves in the planks are correspondingly shaped.

FIG. 9 shows an assembly of co-planar panels, connected with each other in the manner indicated, but as seen in the drawing the panels are of different thickness, thicker ones alternating with thinner ones. This results in the ready cast in a pattern of ribs and recesses on the face of the respective wall or ceiling.

FIGS. 10 and 10*a* show a panel which has near two of its edges undercut grooves 10 and ribs 11 extending normal to the extension of the grooves. The ribs form the rear side of the panel and serve to stiffen it, so as to withstand lateral pressure of the cast.

The panel may be built up of two or three layers, e.g. a timber layer 13 (which is ribbed, or consists of spaced ribs) and a stiffening backing 14 of metal or plastic. Of course, there may be more than these two layers.

The invention is not limited to the shape of the tongues as shown in the drawings, particularly in the practical embodiment of FIGS. 1–8 but it may assume any conceivable form, provided that the groove in the respective plank is accordingly shaped.

As shown in FIG. 15, box-like casements 15' may be inserted into the so prepared shutterings in lieu of some panels, thereby resulting, after casting in the creation of openings for doors and windows. These casements which are afterwards removed from the shuttering may be assembled in the same way and by the same elements and connectors as described in connection with the shutterings themselves. Obviously these casements need not be square or four sided ones only as exemplified by the part *a* but may be also half round or arc shaped as at *b* and the casement may be assembled in the way well known with preparation of centers for casting certain arched structures.

Turning now to FIGS. 14, 14*a*, 14*b*, 14*c*, 16 and 17 showing mounting aids and auxiliary parts, there is shown in FIG. 14 the use of a distance piece conventionally inserted between the two opposite sides of a mold, so as to ensure the uniform distance between the sides at all points of the shuttering. The two sides of the shuttering, being planks or panels, as described above are indicated by the numerals 50 and 50'. The distance piece is a tubular member 33. Now it is well known that there frequently exists some difficulty in properly placing such a distance piece within the shuttering. To meet this difficulty I have devised a novel construction of distance piece which can easily be inserted and put in place. The tubular distance piece 33 is composed of two parts of U-profile, part 31, being the narrower of the two being placed within the wider part, the two facing one another with their open sides. The two parts are hingedly connected at points 34. The part 31 of the tubular member is partly longitudinally slitted resulting in a yielding strip 32. The distance piece 33 is inserted into the mould through an aperature 35 in one side of the mould 50' with its end opposite strip 32 leading. In the second side of the mould 50 there is a like aperature, in register with aperature 35. Through this aperature a toothed tie member 36 is passed into the distance piece 33'', to emerge from it and aperature 35 at its free end. Now onto tie member 36 a washer 41 plate having a keyhole shaped opening 43 is placed with the edges of opening 43 engaging one of the indentations 40 of the tie member. The opposite end of tie member 36 has hinged to it at 38 a claw 37, adapted to be engaged by a hole 39 in member 36. On that part of member 36 slides freely a curved washer plate 42. When tie member 36 is inserted into the distance piece 33, the strip 32 is forced out of the confines of the tubular member 33 and prevents the member 33 from sliding out through the aperture 35. The plate 41 being in position in one of the dents and close to the outside of the shuttering, the claw 37 is forced into the hole 39, thereby pulling plate 41 forcibly towards the outside of the shuttering and pressing plate 42 against it. Thus the two sides 50 and 50' of the shuttering are forced against one another, and are tied and kept at distance by the two ends of distance piece 33. When dismantling the shuttering, all parts are removed and only the distance pieces remain in the concrete, all the tie parts are removed for repeated use.

The connecting means to which reference had been had in relation to FIG. 2*a*, is shown in greater detail in FIG. 16. The connector comprises two parts: A bi-furcated member 15 and a two-headed bolt 16. The two heads 16' of bolt 16'' are flattened at two opposite sides. Head 16' is smaller and narrower than head 16''. The two prongs of the bifurcated member 15 taper towards their free ends. In connecting contacting parts of any of the rails described, the bolt 16 is passed through registering holes in the respective parts. These holes are elongated apertures, narrower than long, so the smaller head of a bolt 16 can be passed therethrough with its flattened sides parallel to the longer edges of the holes. The larger head 16'' does not pass through the holes. Now the bifurceted part 15 is placed straddlingly on the shank of the bolt 16, its prongs being confined between the rail and the head 16' and being wedged therebetween.

FIG. 17 shows a device which is advantageously used in those cases where shutterings of wide extension are prepared for casing, e.g., a long wall.

In such a case an outward bulging of the panels under the lateral pressure of poured in concrete mix must be prevented. To this purpose the device shown in FIG. 17 has been designed. In the drawing the respective rail and panel is indicated by the number 4, while connecting rails are numbered 19. To the rails 19 are connected — in any conventional manner — a number of superposed members 20 to each of which is hingedly connected at 21 a rod 22. Each rod is hinged, at its opposite end to a common connector 23 having a spike 24 to be driven into the ground. The members 20 are adjusted at a level commensurate with the position of rail 19 and the distance of member 23 from the rail 4. In this way the rods 22 afford lateral support to the shuttering, prevent an outward bulging of the panels and exert a stiffening action on the shuttering.

I claim:

1. A set of elements for the assembly of casting molds, comprising:

a plurality of planks each having a casting surface, an opposite surface and two edges, and adapted to be joined together adjacent one another to form a portion of a casting mold, with a second edge of a first plank being joined adjacent to a first edge of a second plank; the casting surface of each of said planks being adapted to have cast thereagainst a fluent castable material for hardening thereagainst and from which said planks can be readily stripped; each of said planks being provided with two grooves on its opposite surface, each of said two grooves being located adjacent a respective one of the two edges of each plank, each of said two grooves having an undercut dove-tail side closest to the respective edge to which it is adjacent; and means to join two said planks to one another to define a portion of a casting mold, said joining means comprising a pair of profiled rails, each of said rails having a tongue complementary in shape to the grooves in said planks, and connector means to tighten said rails together when the tongues of said rails interlock with the grooves of said planks to tightly hold said planks together.

2. A set of elements in accordance with claim 1 wherein said casting surface of said planks is ornamented.

* * * * *